United States Patent [19]

Yamada et al.

[11] Patent Number: 4,707,778

[45] Date of Patent: Nov. 17, 1987

[54] CONTROLLER FOR HEAT POWER PLANT

[75] Inventors: Hiroshi Yamada, Hitachi; Michihiro Iioka; Akira Sugano, both of Katsuta; Atsushi Takita, Mito; Seiitsu Nigawara; Masayuki Fukai, both of Hitachi, all of Japan

[73] Assignee: Hitachi, Ltd., Tokyo, Japan

[21] Appl. No.: 752,855

[22] Filed: Jul. 8, 1985

[30] Foreign Application Priority Data

Jul. 9, 1984 [JP] Japan ..... 59-140533
Jul. 20, 1984 [JP] Japan ..... 59-149526

[51] Int. Cl.[4] ..... G06F 15/46; G06F 15/16; G06F 11/16

[52] U.S. Cl. ..... 364/132; 364/187; 364/494; 371/9

[58] Field of Search ..... 364/492, 494, 132, 187, 364/131, 137, 138; 371/9

[56] References Cited

U.S. PATENT DOCUMENTS

| | | | |
|---|---|---|---|
| 4,015,548 | 4/1977 | Schuss | 364/132 |
| 4,319,320 | 3/1982 | Sato et al. | 364/494 |
| 4,347,564 | 8/1982 | Sugano et al. | 364/132 |
| 4,472,783 | 9/1984 | Johnstone et al. | 364/132 |

OTHER PUBLICATIONS

IBM Technical Disclosure Bulletin; vol. 22, No. 3; Aug. 1979; pp. 1131 and 1132.
Advances in Instrumentation; vol. 38, Part 2; Oct. 1983; pp. 1275–1284; Development of Fault Tolerant Distributed Control System.
Advances in Instrumentation; vol. 38, Part 2; Oct. 1983; pp. 1285–1291; Back-Up System of Distributed Control System.
Advances in Instrumentation; vol. 35, Part 1; 1980; pp. 293–302; Combustion Control Security.

*Primary Examiner*—Jerry Smith
*Assistant Examiner*—Allen MacDonald
*Attorney, Agent, or Firm*—Antonelli, Terry & Wands

[57] ABSTRACT

A master controller receives a load demand and a plurality of plant data from a heat power plant and outputs command signals on at least two of an electric power, a feed water flow rate, a fuel flow rate, an air flow rate and a recirculation gas flow rate of the plant required to achieve the load demand. A plurality of sub-loop controllers independently provided one for each of the command signals provide control quantities for controlling respective control ends in accordance with the command signals. A transmission loop is arranged between the sub-loop controllers and the master controller. Drive means drive the control terminals provided one for each of the control quantities supplied from the sub-loop controllers. An I/O bus is arranged between one of the sub-loop controllers and the drive means driven by the command signal for the one sub-loop controller. Detection means detect the plant data to be delivered to the master controller or the sub-loop controllers.

10 Claims, 25 Drawing Figures

FIG. 7A-a

| FIG. 7A -a | FIG. 7A -b |
|---|---|

FIG. 7A-b
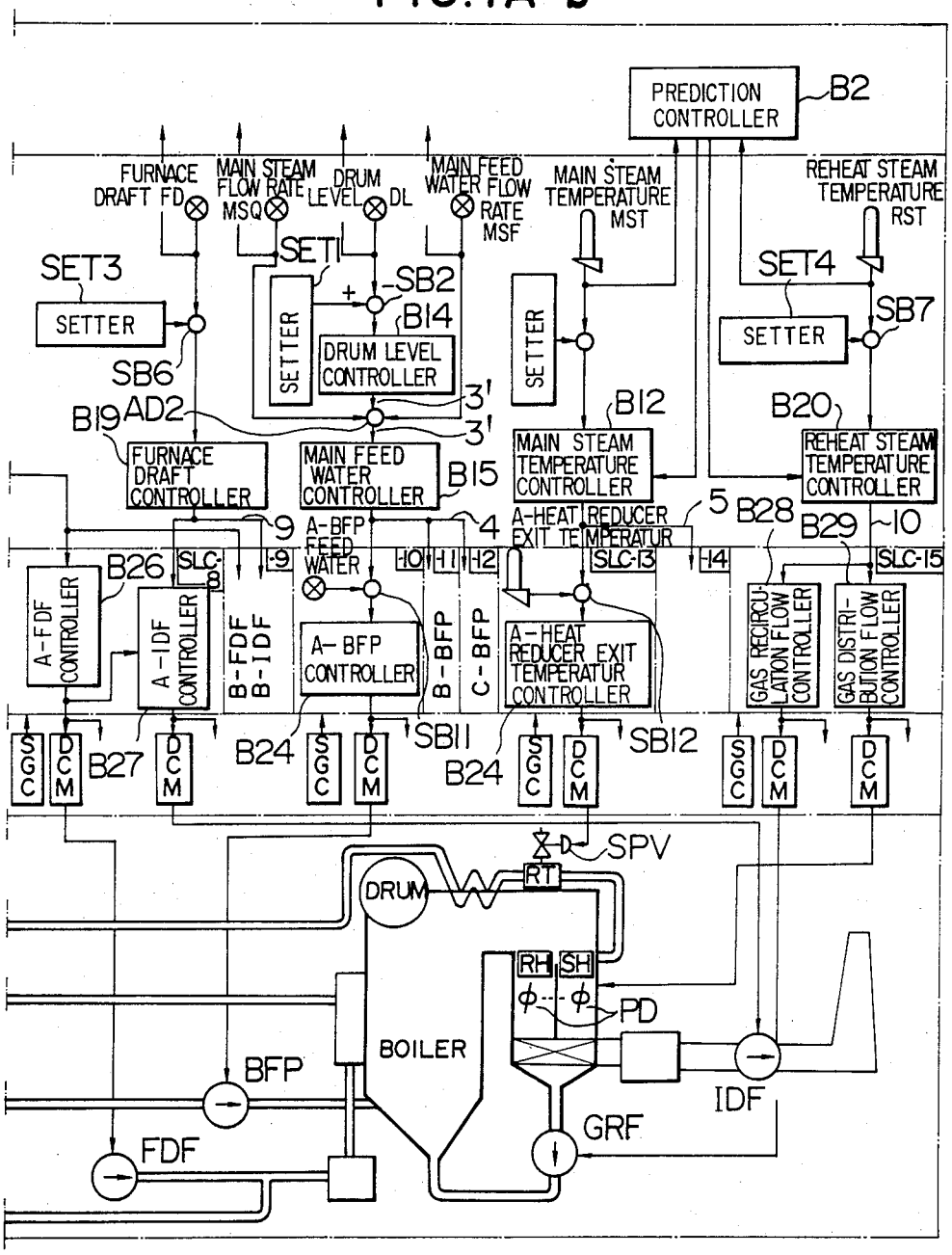

FIG.7B-a

| FIG.7B -a | FIG.7B -b |
|---|---|

FIG. 7B-b
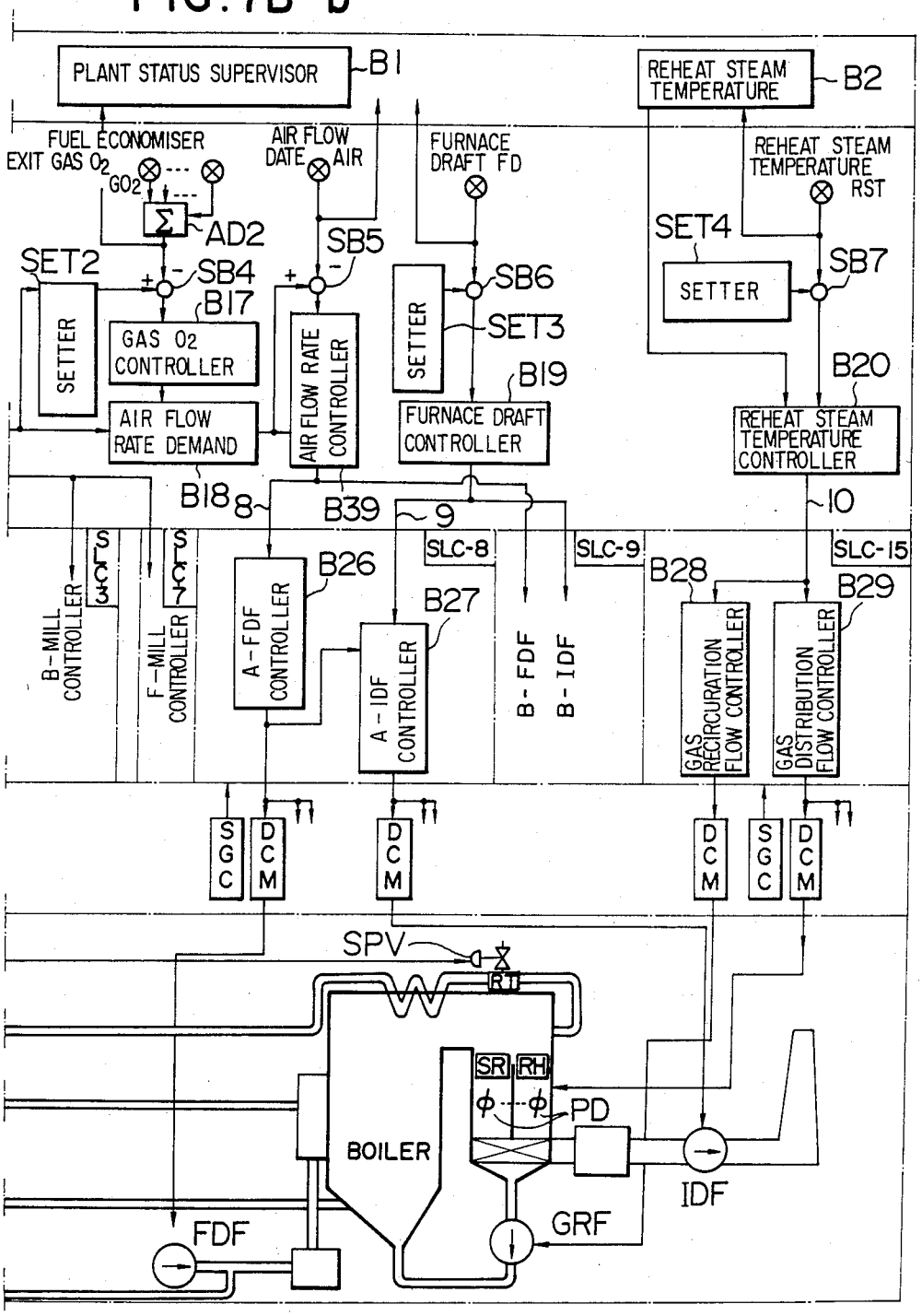

FIG. 19

| | | MAIN CONTROL OBJECT | |
|---|---|---|---|
| | | DRUM BOILER | ONE-THROUGH BOILER |
| SYSTEM | FEED WATER SYSTEM | DRUM LEVEL | MAIN STEAM PRESSU |
| | FUEL SYSTEM | MAIN STEAM PRESSURE | MAIN STEAM TEMPERATURE |
| | AIR SYSTEM | GAS O2 | GAS O2 |
| | GAS SYSTEM | FURNACE DRAFT | FURNACE DRAFT |
| | RECIRCULATION SYSTEM | REHEAT STEAM TEMPERATURE | REHEAT STEAM TEMPERATURE |

FIG. 20

| | | |
|---|---|---|
| SYSTEM | FEED WATER SYSTEM | FEED WATER PUMP FLOW RATE |
| | FUEL SYSTEM | COAL FLOW RATE AND PRIMARY AIR FLOW RATE FOR EACH MILL |
| | AIR SYSTEM | FDF DISCHARGE PRESSURE |
| | GAS SYSTEM | IDF DISCHARGE PRESSURE |
| | RECIRCULATION SYSTEM | GRF DISCHARGE PRESSURE |

CONTROLLER FOR HEAT POWER PLANT

BACKGROUND OF THE INVENTION

The present invention relates to a controller for a heat power plant, and more particularly to a controller for a heat power plant which can minimize an effect to the heat power plant when trouble occurs in the controller.

The heat power plant which has a social mission to stably supply power must be operated with a high reliability. To this end, plant equipments as well as a plant controller are designed for high reliability and the controller is designed to prevent stop of the plant even if the controller stops by failure. For example, in U.S. Pat. No. 4,347,564, the controller is partially duplicated so that a host computer is used when a master controller fails. In Japanese unexamined patent publication No. 50-143,989, a so-called one-to-n backup system is used in which a backup sub-loop controller which is normally not used is started when a normal sub-loop controller fails. In such multiple systems, even if trouble occurs in one controller, the heat power plant can continue operation and a highly reliable controller is provided. However, since the multiple system needs at least one redundant controller of the same function, the cost of the controller system is increased.

SUMMARY OF THE INVENTION

It is an object of the present invention to provide a controller for a heat power plant which can minimize an effect to the plant operation by a failure of the controller with a minimum multiplicity of the controller.

In accordance with the present invention, the controller comprises at least one master controller for receiving a load demand and a plurality of plant data from a heat power plant and outputting command signals on at least two of an electric power, a feed water flow rate, a fuel flow rate, an air flow rate and a recirculation gas flow rate of the plant required to achieve the load demand, a plurality of sub-loop controllers independently provided one for each of the command signals for providing control quantities to control respective control terminals in accordance with the command signals, a transmission loop arranged between the sub-loop controllers and the master controller, drive means provided one for each of the control quantities supplied from the sub-loop controllers for driving the control terminals, an I/O bus arranged between one of the sub-controllers and the drive means to be driven by the command signal for the one sub-loop controller, and detection means for detecting plant data to be delivered to the master controller or the sub-loop controllers.

BRIEF DESCRIPTION OF THE DRAWINGS

FIGS. 19 and 20 show process signals required to back up a higher level controller by a lower level controller when the higher level controller fails.

DESCRIPTION OF THE PREFERRED EMBODIMENTS

A basic concept of the construction of a heat power plant and the construction of a controller for the heat power plant is first explained.

Figure 1:
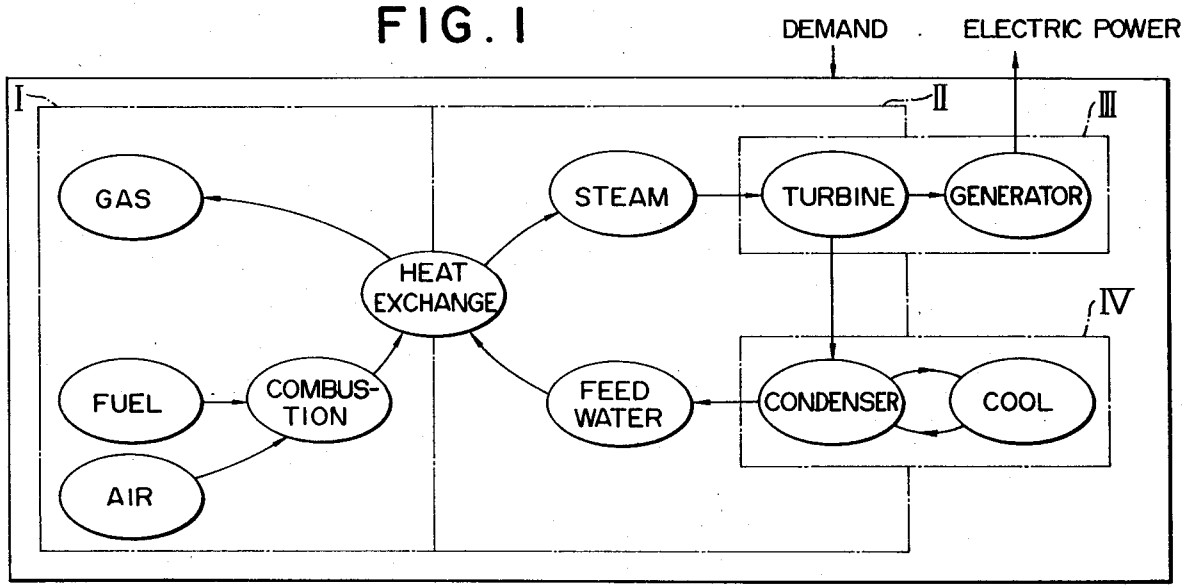
FIG. 1 illustrates a process configuration in a water-steam process.

FIG. 1 illustrates a concept of division of the control system in accordance with a plant characteristic of the heat power plant.

Figure 2:
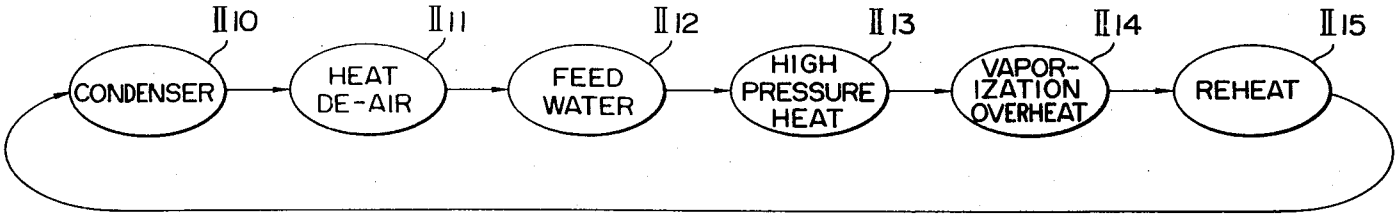
FIG. 2 illustrates a sub-process configuration in the water-steam process.

The heat power plant is an aggregation of complex processes in which various functions are related to each other in a complex manner. When it is classified by material and energy flow, it comprises four processes, combustion process I, water-steam process II, power generation process III and cooling process IV, as shown in FIG. 1. The control of the heat power plant is to combine and coordinate those four processes so that a power is stably supplied to meet an external power demand. Each of the processes shown in FIG. 1 can be further classified by sub-processes in accordance with the associated functions. FIG. 2 shows sub-processes of the water-steam process II. II 10 in the drawing is a condensing sub-process, II 11 is a low pressure feed water and heating and deairing sub-process, II 12 is a feed water sub-process, II 13 is a high pressure feed water and heating sub-process, II 14 is a vaporization and overheat sub-process, and II 15 is a reheat sub-process. Each sub-process has a plurality of micro-processes of the same capacity as required to enhance a resistance of the plant. Each micro-process may be further subdivided with respect to the equipment associated therewith.

Figure 3:
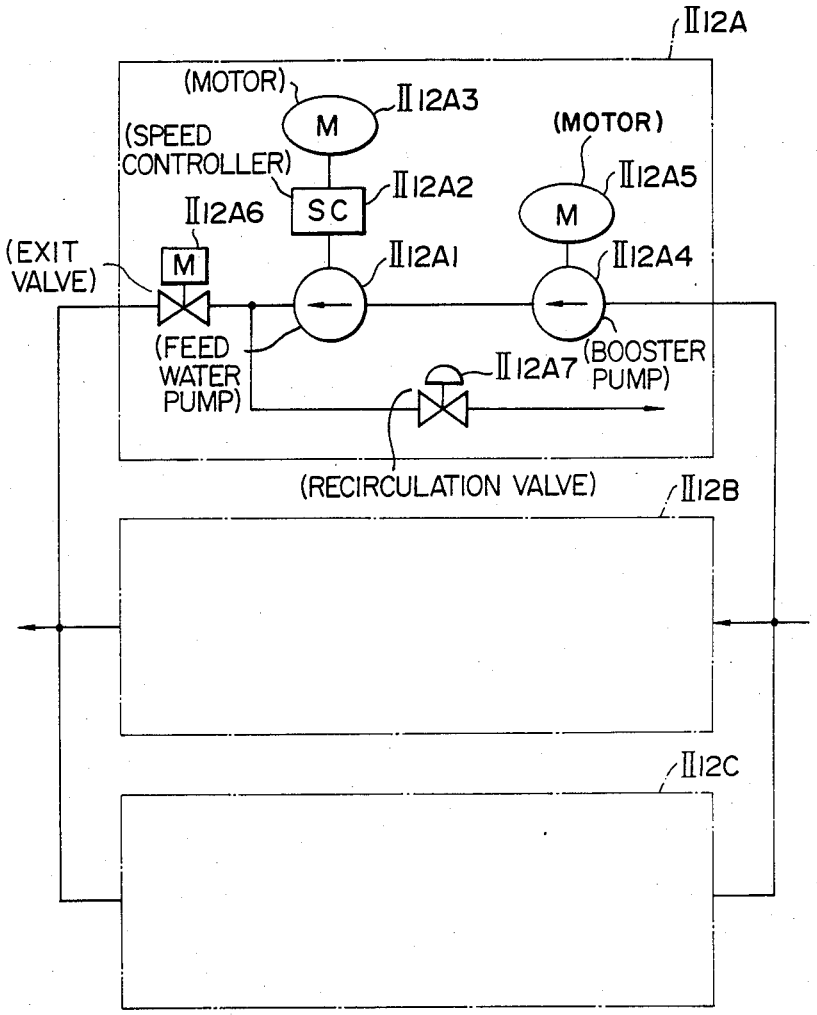
FIG. 3 illustrates a micro-process configuration in a feed water sub-process.
Figure 4:
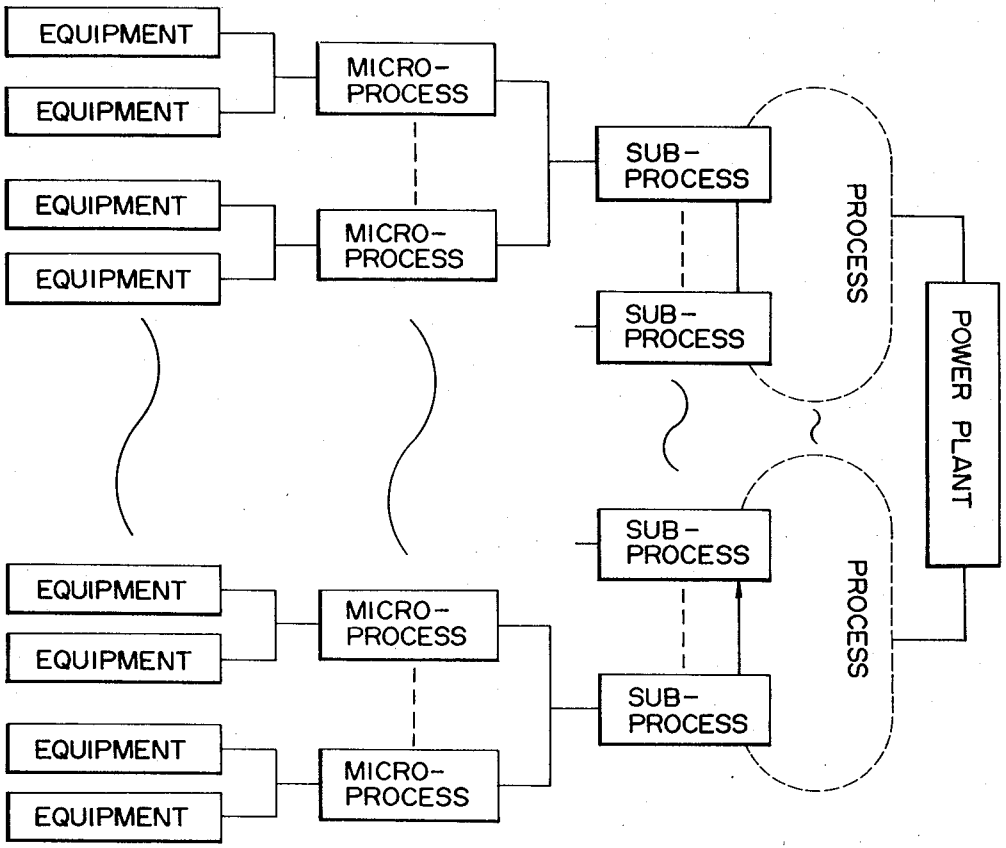
FIG. 4 shows a heat power plant process and a configuration of equipments.
Figure 5:
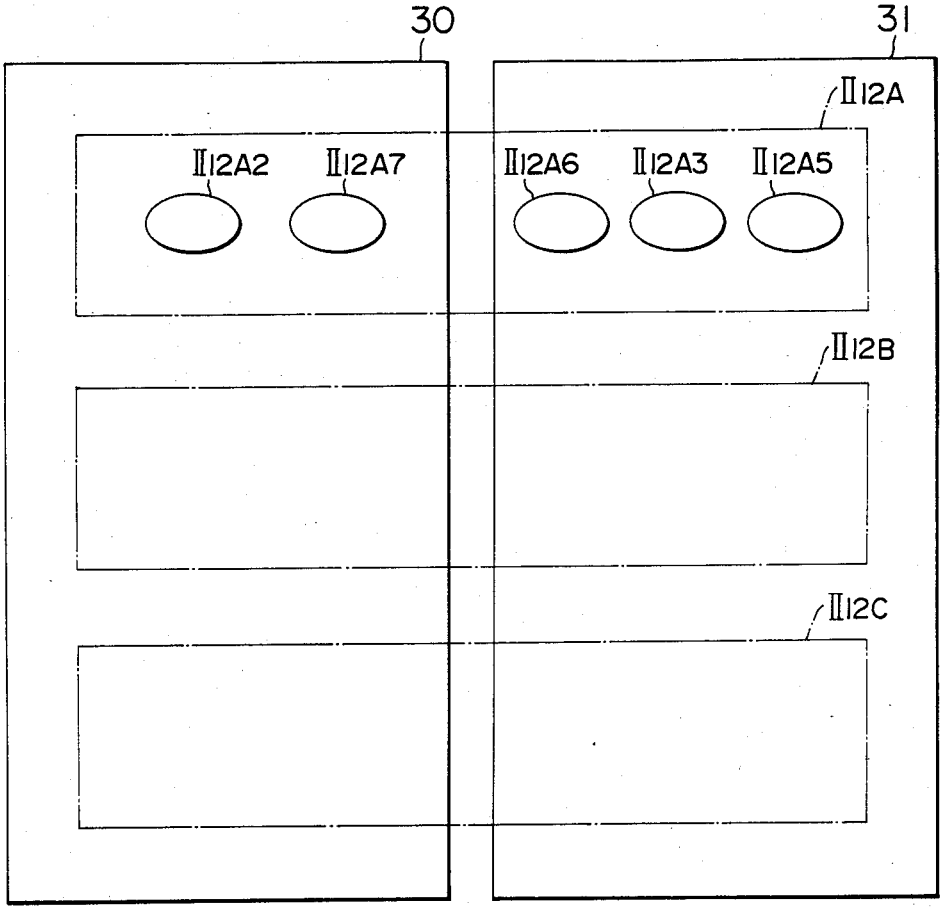
FIG. 5 PRIOR ART
FIG. 5 shows a prior art process and an arrangement of a controller.

FIG. 3 shows the feed water sub-process II 12 subdivided by the micro-processes and the equipment of the sub-process. II 12A–II 12C are feed water pump micro-processes. The equipment in the micro-process II 12A includes feed water pump II 12A1, feed water pump speed controller II 12A2, feed water pump motor II 12A3, feed water booster pump II 12A4, feed water booster pump motor II 12A5, feed water pump exit valve, II 12A6 and feed water pump recirculation valve II 12A7. In summary, the power generation plant configuration can be divided according to the levels of process, sub-process, micro-process and equipment involved. If trouble occurs in the process level or sub-process level of the plant, the continuation of the operation of the plant is, in many cases, not allowed and the plant operation is stopped. However, if trouble occurs in the micro-process level or the equipment level, the continuation of the operation may be allowed with a reduced plant output. In the past, however, the plant analysis was not sufficiently made and the result thereof was not reflected to the controller configuration. In a feed water process shown in FIG. 5, a feed water flow rate controller 30 for an analog controller and a feed water control sequencer 31 for an ON-OFF controller are arranged across a plurality of micro-processes II 12A–II 12C. Trouble in the controller 30 or 31 disables the continuation of automatic operation of the micro-processes II 12A II–12C. This means that the continuation of automatic operation of all of the micro-processes in the feed water sub-process 12 is not allowed, which imparts a serious problem to the continuation of the plant operation. In the present invention, the plant is divided in accordance with the plant characteristics, and DCM's (drive control modules) and SGC's (signal conditioning modules) are arranged as lowest level controllers for the equipment. Sub-loop controllers are arranged as higher level controllers to the micro-processes. A master controller is arranged as a higher level controller to the process and the sub-processes in order to cooperatively control the process and the sub-processes. And a supervising controller is provided at the highest level. Those controllers are constructed in a simplex system.

Figure 6:
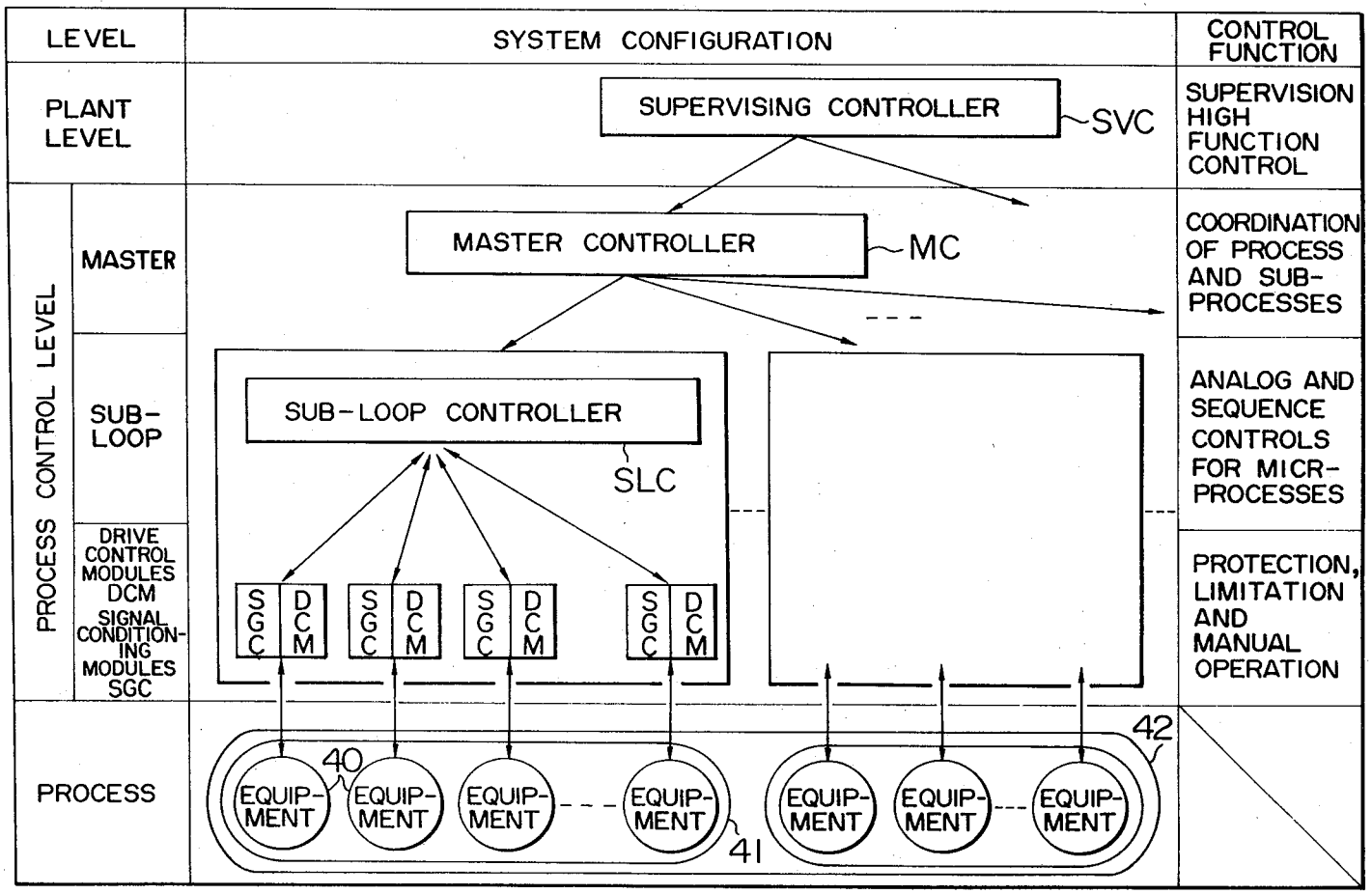
FIG. 6 shows a basic concept of an arrangement of a controller in the present embodiment.

FIG. 6 shows a basic concept of the above system. Numeral 40 denotes the equipment, and numeral 42 denotes the sub-process. The SGC process data inputs from the process. The DCM control the equipment 40 by a control signal or a manual command for each equipment. The SGC and DCM are the smallest units in the system and effect manual operations, and protection and limitation of the equipment. SLC denotes a sub-loop controller arranged for each micro-process which includes the DCM and the SGC to effect analog control and sequence control. MC denotes a master controller which controls a plurality of sub-loop controllers SLC and coordinates the process and the sub-processes. SVC denotes a supervising controller which effects high function controls such as overall plant supervision, non-machine interface, data logging, document formation, down-loading of a control program, correction of programs and prediction control.

Figure 7A:
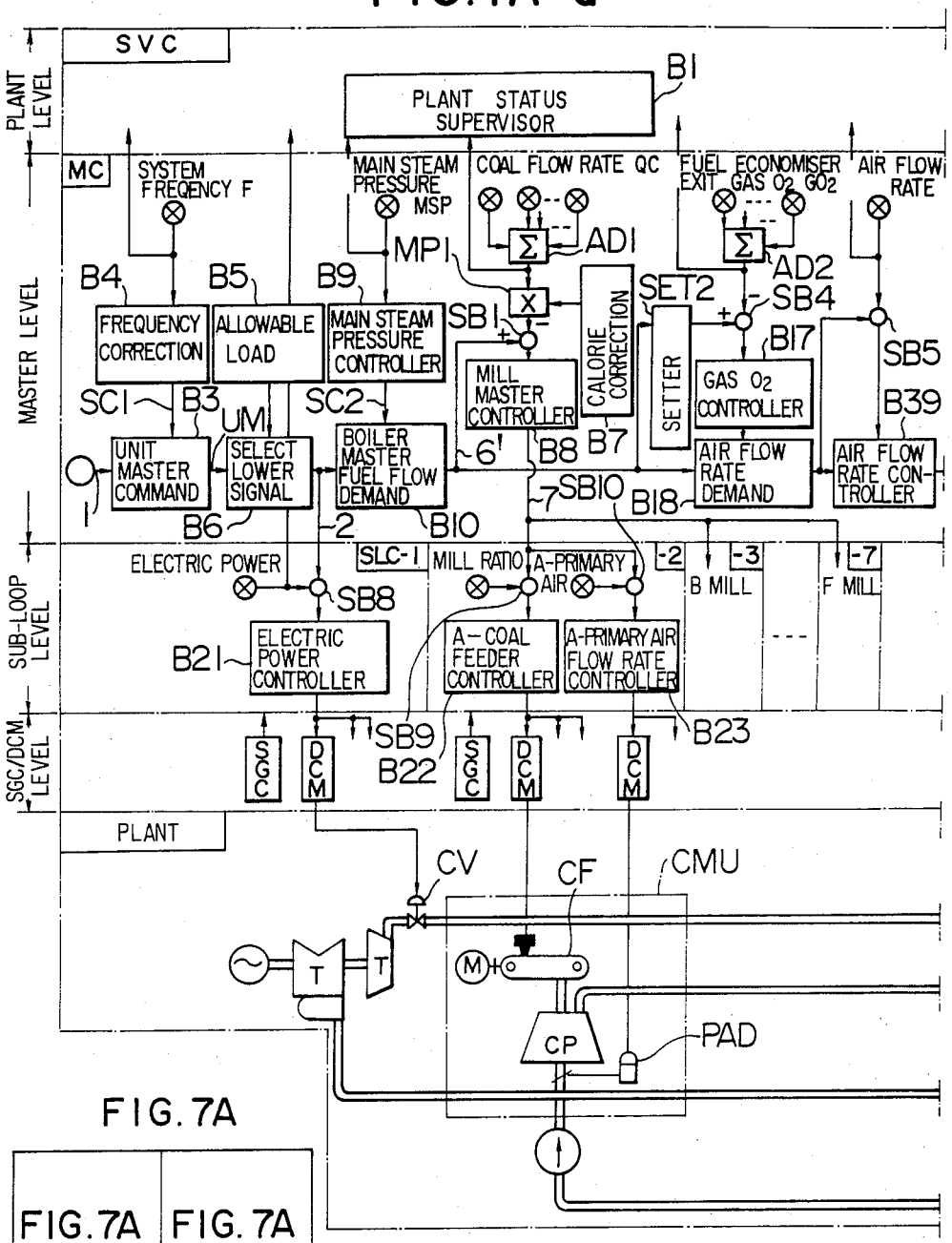
FIG. 7A is a drum type control system configuration in accordance with the present invention, respective halves of which are illustrated in FIGS. 7A-*a* and 7A-*b*.
Figure 7B:
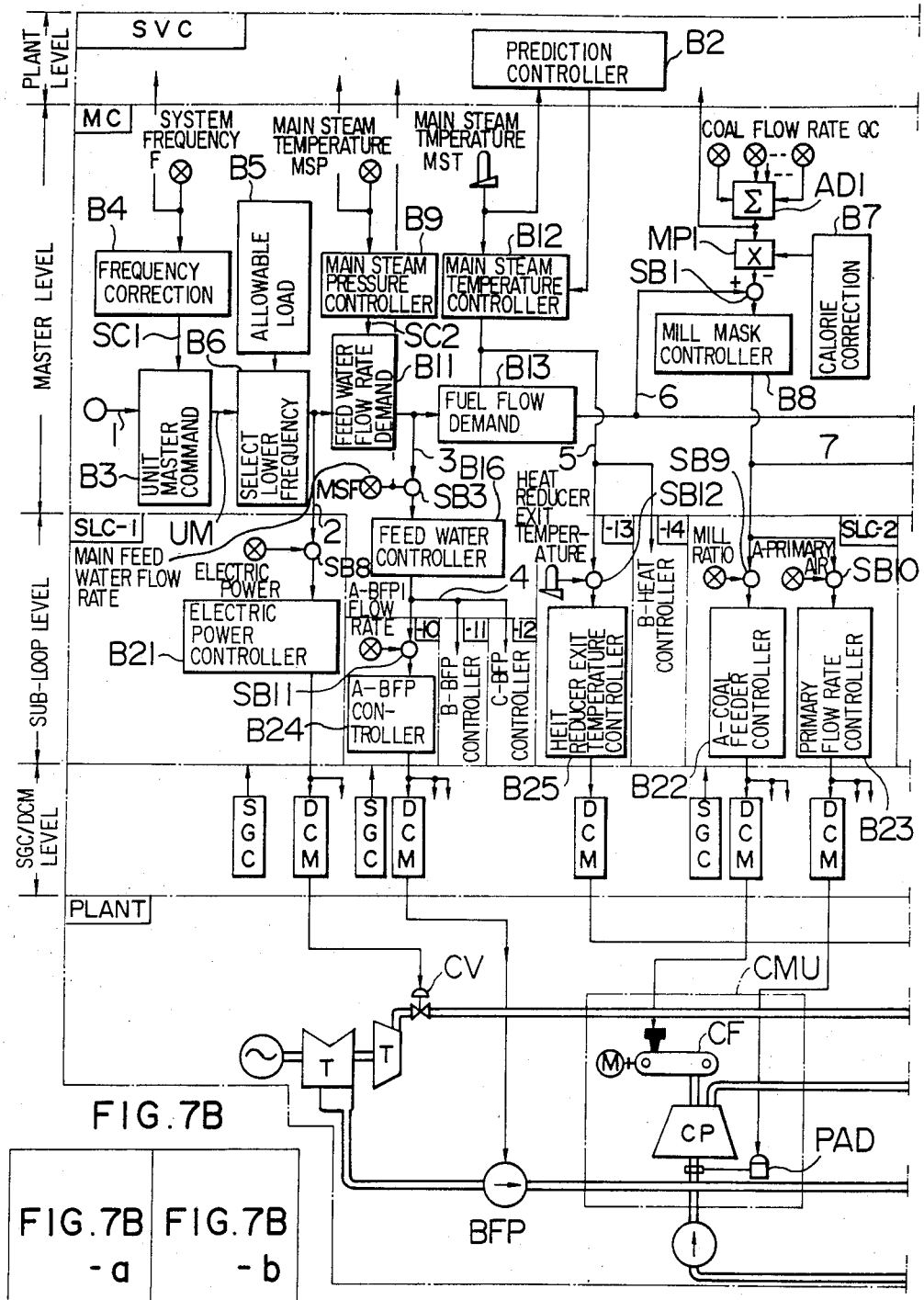
FIG. 7B is a one-through type control system configuration in accordance with the present invention, respective havles of which are illustrated in FIGS. 7B-*a* and 7B-*b*.

FIG. 7A and the related FIGS. 7A*a* and 7A-6 show a control system configuration for a drum type boiler power plant in accordance with the above concept, and FIG. 7B and the related FIGS. 7B-*a* and 7B-6 show a control system configuration for a one-through type boiler power plant. The controller comprises a supervising controller SVC, a master controller MC and fifteen sub-loop controllers SLC. In the drum type boiler of FIG. 7A, the master controller MC receives a system frequency F, a main steam pressure MSP, fuel economizer exit gas $O_2$, $CO_2$, an air flow rate AIR, a furnace draft FD, a drum water level DL, a main steam temperature MST, a reheat steam temperature RST, a fuel flow rate or coal flow rate QC, a main steam flow rate MSQ and a main feed water flow rate MSF to control the process and the sub-processes while coordinating them. In the one-through type boiler, the heat power plant is not equipped with a drum and does not control the feed water by the three elements, main steam flow rate MSQ, drum water level DL and main feed water flow rate MSF. Therefore, the master controller MC of FIG. 7B does not essentially need the drum level DL. In the master controller MC for the one-through type boiler, the air flow rates AIR and the main steam flow rate MSQ are also not received. The input data to the master controller MC are monitored by a plant status supervisor B1 of the supervising controller SVC. In order to exactly control the boiler, it is preferable to predict the future values of the main steam temperature MST, and the reheat steam temperature RST and control them. Accordingly, MST and RST are appropriately predicted by a prediction controller B2 of the SVC. The master controller MC further receives a load demand 1 from a central power supply command station and sends the demand to the sub-loop controllers SLC. Relations between the demand and the SLC which receives the demand are shown below.

SLC 1: electric power demand 2
SLC 2–7: coal mill master demand 7
SLC 8, 9: air flow demand 8 furnace draft demand 9
SLC 10–12: feed water flow demand 4
SLC 13–14: main steam temperature demand 5
SLC 15: reheat steam temperature demand 10

The master controller MC prepares the above demands in the following manner.

Electric power demand 2

The electric power demand 2 is common to the drum type boiler and the onethrough type boiler. A frequency correction unit B4 generates a correction signal SC 1, and a unit master instruction unit B3 corrects the central load demand 1 by SC 1 to produce a unit master demand UM. In a unit B5, a maximum allowable load for continuous operation by spare machines when some of them are tripped is set. A unit B6 selects a smaller one of the outputs of B3 and B5 and sets it as the electric power demand.

Coal mill master demand 7

An adder AD1 calculates a total coal flow and an output of AD1 is multiplied by an output of a heat correction unit B7 which is determined in accordance with a type of coal, in a multiplier MPl, which produces an actual total fuel flow. A subtractor SB1 calculates a difference from a target 6 or 6', and a mill master controller B8 determines a mill master demand in accordance with the difference. A signal 7 indicates a total coal flow required to meet the load demand 1. The total fuel demands 6 and 6' are determined in different manners depending on the type of boiler. For the drum type boiler (FIG. 7A), it is corrected by the main stream pressure for the electric power demand 2. A signal SC2 for keeping the main stream pressure constant is obtained in a unit B9, and the demand 2 is corrected by the signal SC2 in a boiler master unit B10, which produces the fuel demand 6'. For the one-through type boiler (FIG. 7B), a feed water flow demand unit B11 corrects the demand 2 by the signal SC2 to produce the total feed water demand 3. A fuel flow demand unit B13 corrects the feed water demand 3 by a main steam temperature demand 5 supplied by a control unit B12 which maintains the main stream temperature constant, to produce the fuel flow demand 6.

Feed water flow demand 4

For the drum type boiler of FIG. 7A, the feed water flow demand 4 to be supplied to the respective boiler feed water pumps BFP is produced by the so-called three-element control. A subtractor SB2 calculates a difference between a target water level preset by a setter SET 1 and an actual water level, and a drum level control unit B14 produces a drum level control signal 3'. The drum level control may be effected by a signal 3" but because of a poor control response, the difference between the main steam flow MSQ and the main feed water flow MSF is added to the control signal 3" in an adder AD2 to produce the control signal 3'. A main feed water control unit B15 produces the feed water demand 4 for the BFP by the control signal 3'. In the one-through type boiler of FIG. 7B, the total feed water flow demand 3 is determined in accordance with the load demand and it is compared with the actual total feed water flow in the subtractor SB3 and a feed water control unit B16 determines the feed water demand 4 for the BFP in accordance with the difference.

Air flow demand 8

Basically, the air flow demand 8 is obtained by correcting the fuel flow demand 6' or 6 determined by the unit B10 of FIG. 7A or the unit B13 of FIG. 7B by the quantity of $O_2$ in the combustion gas. The quantity of $O_2$ in the gas at the exit of the fuel economiser is calculated by the adder AD2, and a difference from the $O_2$ target preset by the setter SET 2 is calculated by a subtractor SB 4. A unit 17 is a controller to keep $O_2$ in the gas constant and an air flow demand operation unit B18 corrects the fuel flow demand 6 with the output of the control unit 17. A subtractor SB 5 calculates a difference between the output of the unit B18 and the actual air flow and a unit B19 corrects the output of the unit B18 by the output of the subtractor SB 5 to produce the air flow demand 8.

Main steam temperature demand 5

A unit B12 proportional-integrates the main steam temperature error to produce the main steam temperature demand 5.

Furnace draft demand 9

A subtractor SB 6 calculates a difference between an output of a setter SET 3 and the furnace draft and a control unit B19 proportional-integrates the difference to produce the furnace draft demand 9.

Reheat steam temperature demand 10

A subtractor SB 7 calculates a difference between an output of a setter SET 4 and the reheat steam temperature, and a control unit B20 proportional-integrates the difference to produce the demand 10.

The master controller MC is constructed as shown in FIG. 7A or 7B depending on the type of boiler and sends the above demand signals to the sub-loop controllers SLC. In the SLC, SB 8–SB 12 denote subtractors which calculate differences between the demands from the master controller MC and the detected process status, and B21–B25 denote control functions such as proportional integration, and specifically controllers for electric power, coal feeder, primary air flow, BFP and steam temperature at an exit of a heat dissipator. Thus, SLC 1–7 and 10–14 constitute the feedback control. SLC 8, 9 and 15 constitute an open loop control, and B26–B29 are equipped with function generators for controlling FDF, IDF, gas recirculation and gas distribution flow.

On the other hand, the DCM sends the control signal from the sub-loop controller SLC to the control terminal and, in the manual operation mode, switches the output of the sub-loop controller to produce the manual control command.

The bottom stages in FIGS. 7A and 7B show schematic diagrams of known heat power plants. Relations between the outputs of the SLC and the portions of the plant controlled thereby through the DCM are explained below.

SLC 1: A steam control valve CV at an entry of a turbine T. Since four to eight CV's are usually arranged, the DCM's are arranged one for each CV.

SLC 2–7: A coal boiler is shown. A feed speed (fuel flow rate) of a coal feeder CF which feeds coal to a coal pulverizer CP, and an opening of a damper PAD for controlling a primary air flow to feed the pulverized coal to the boiler. A plurality of coal pulverizer units CMU comprising CF, CP and PAD are usually arranged and each unit is controlled by one SLC. In the illustrated embodiment, six SLC's and six CMU's are provided.

SLC 8, 9: A forced draft fan FDF for controlling air flow to the boiler, and an induced draft fan for controlling gas flow from the boiler. Two FDF's and two IDF's are provided in parallel and one set of FDF and IDF is controlled by the SLC 8 while the other set is controlled by the SLC 9.

SLC 10, 12: A boiler feed pump BFP for controlling the feed water flow to the boiler, a plurality of (three in the illustrated embodiment) BFP's are arranged as indicated. An A-BFP is controlled by the SLC 10, a B-BFP is controlled by the SLC 11 and a C-BFP is controlled by the SLC 12.

SLC 13, 14: An opening of a spray valve SPV of a heat reducer RT for cooling the steam generated by the boiler. Two heat reducers are provided and one is controlled by the SLC 13 while the other is controlled by the SLC 14.

SLC 15: A gas recirculation fan GRF for reintroducing a combustion gas into the boiler to reduce NOX (nitrogen-oxide mixture), and a parallel damper PD which separately introduces a reheater RH and a primary super heater SH to a flue to control gas flows.

Figure 8:
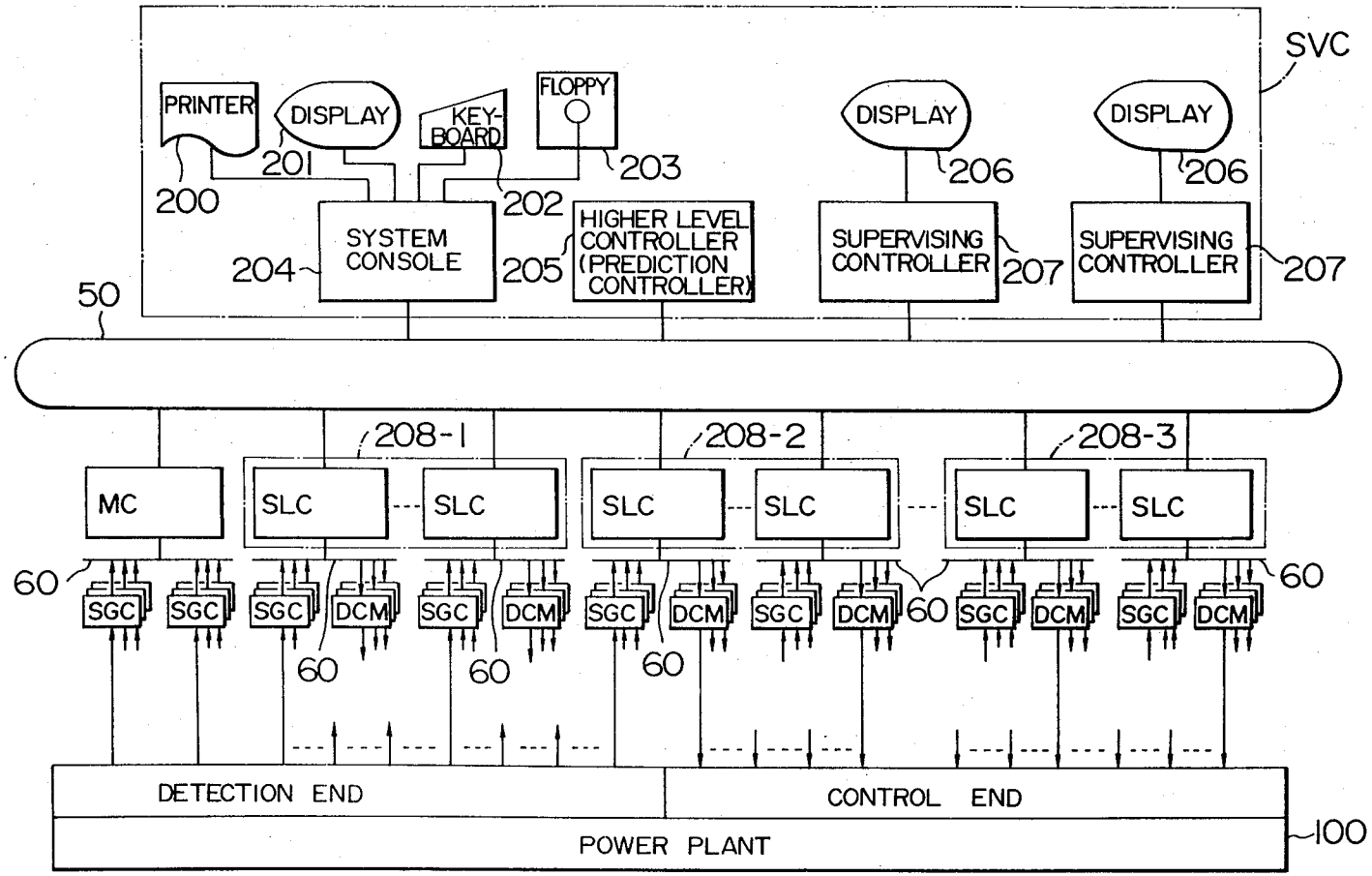
FIG. 8 shows a hardware configuration of the present controller.

The system configuration was shown in FIGS. 7A and 7B to illustrate the division of the control function. An actual hardware configuration is shown in FIG. 8. The like numerals to those used in FIG. 1 are shown. Numeral 50 denotes a serial data transmission loop which functionally couples a plurality of distributed sub-loop controllers SLC, the master controller MC and the supervising controller SVC.

Numeral 200 in SVC denotes a printer, numerals 201 and 206 denote displays, numeral 202 denotes a keyboard, numeral 203 denotes a floppy, numeral 204 denotes a system console, numeral 205 denotes a higher level controller used for prediction control, numeral 207 denotes the supervising controller and numeral 208 denotes SLC's. In the embodiment of FIG. 7A, numeral 208-1 denotes feed water controlling SLC's (SLC 10–12 in FIG. 7A), numeral 208-2 denotes mill controlling SLC's (SLC 2–7 in FIG. 7A) and numeral 208-3 denotes air flow rate controlling SLC's (SLC 8, 9 in FIG. 7A). Each SLC has a plurality of SGC's and DCM's and the SLC and the SGC's and DCM's are coupled through an I/O bus 60. The master controller MC has no DCM and a plurality of SGC are coupled through the bus 60. The signal conditioning module SGC detects the status of the power plant 100 such as the detector outputs shown in FIG. 7A and sends them to the SLC and the MC. The drive control module DCM drives the equipments in the power plant 100 in accordance with the output from the SLC. The controllers of the present invention are of hierachy configuration as shown in FIG. 8, and each sub-loop controller SLC receives the target value from the MC and provides the control quantities of the equipment to the DCM.

Figure 9:
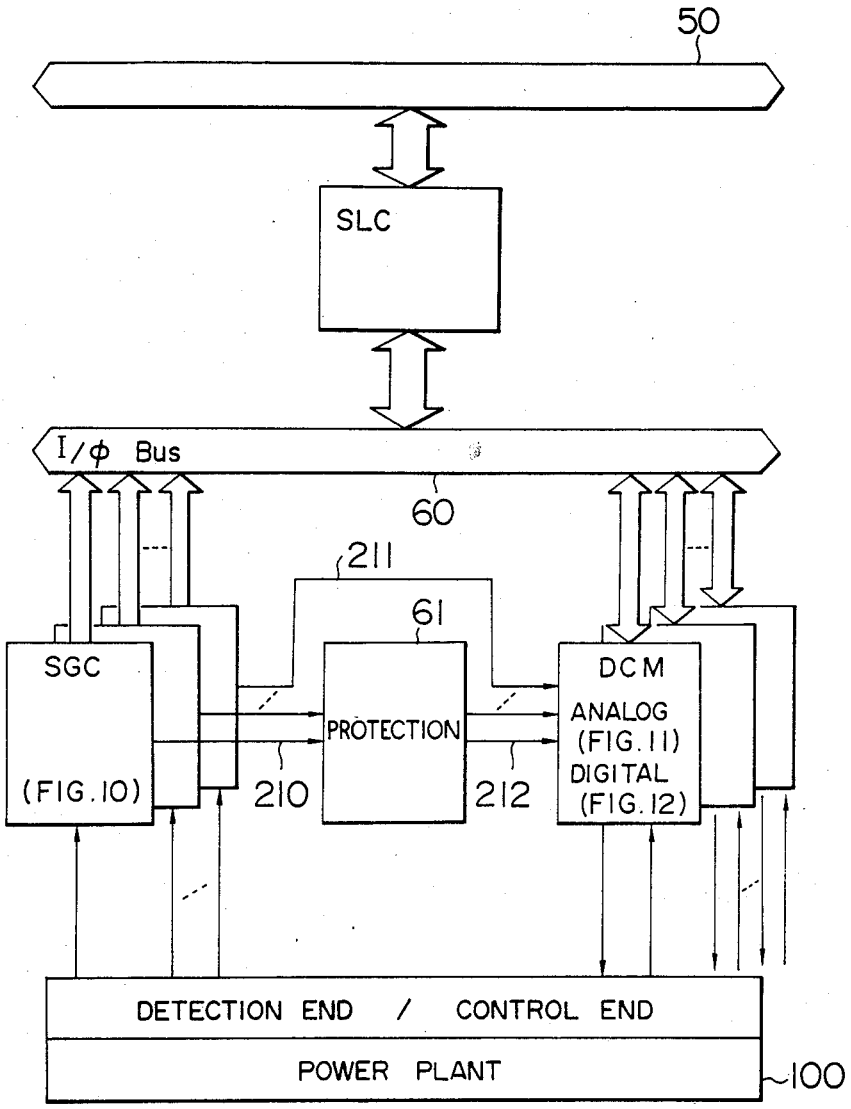
FIG. 9 shows a basic system configuration including SLC, DCM and SGC in the present invention.

FIG. 9 shows one of the SLC's and the SGC's and PCM's coupled thereto. Numeral 50 denotes the serial data transmission loop which couples the sub-loop controller SLC to other controllers MC and SLC's. Numeral 60 denotes the I/O bus which couples the sub-loop controller SLC to the SGC's and DCM's. The sub-loop controller SLC is a processor comprising a BPU and a memory, and the SGC and the DCM are I/O devices.

Figure 10:
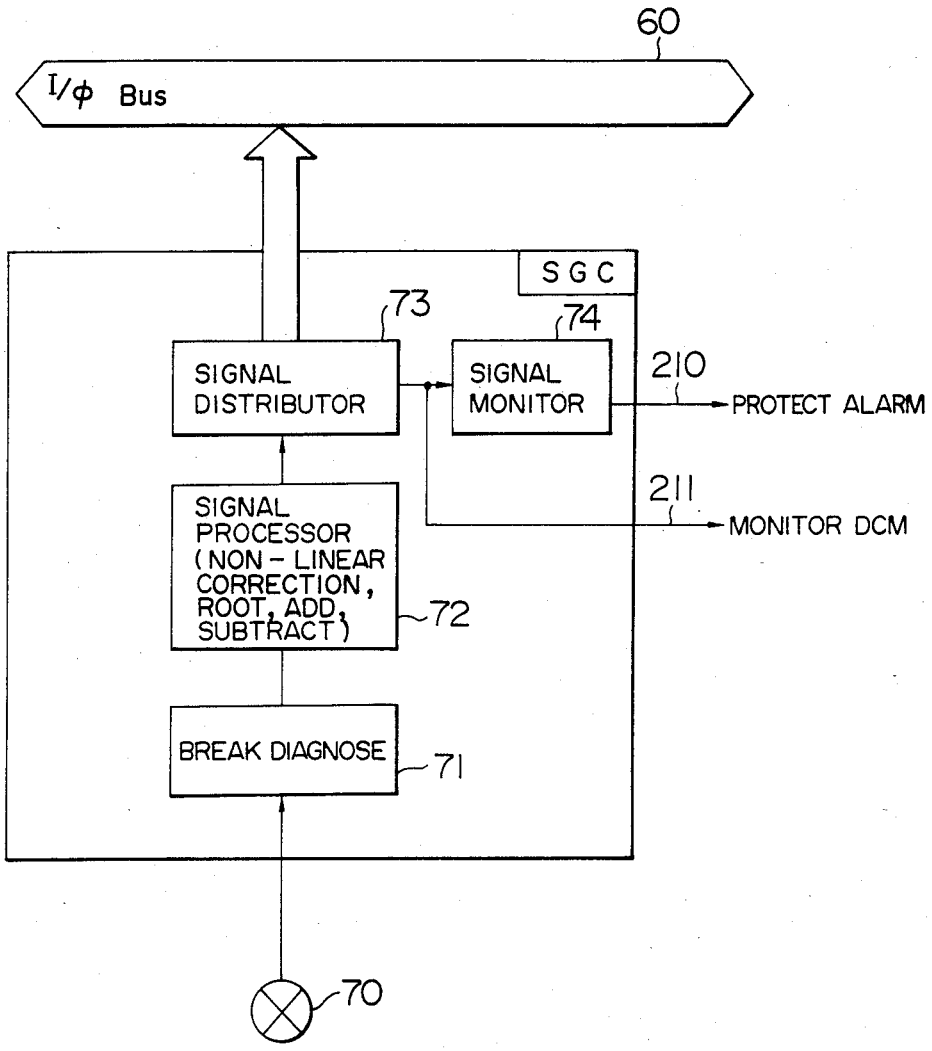
FIG. 10 is a functional diagram of SGC.

The function of an SGC is explained with reference to FIG. 10. The SGC is basically provided one for each detector and detects a break of the wiring by a block 71 for a signal from a detection end 70. The break can be detected by an abrupt change of an input signal. A block 72 makes non-linear correction, rooting, addition and subtraction as required. It compensates for a non-linear characteristic of a value opening signal, calculates a difference between two input pressure signals and a root of the difference to produce a signal representing a flow rate, and multiplies the signal by a predetermined gain. A block 73 converts the signal to a digital signal and distributes it to the higher level controller such as the sub-loop controller SLC through the I/O bus 60, and to a meter and the DCM without routing the I/O bus 60. For example, it sends the process signal to the meter and the DCM through a signal line 211 without routing the I/O bus 60 to monitor and control the process signal. It also monitors the process signal by a block 74 to detect a failure in the higher order controller and produce alarming and protecting contact outputs through the signal line 210 to the monitor and protection function 61.

Figure 11:
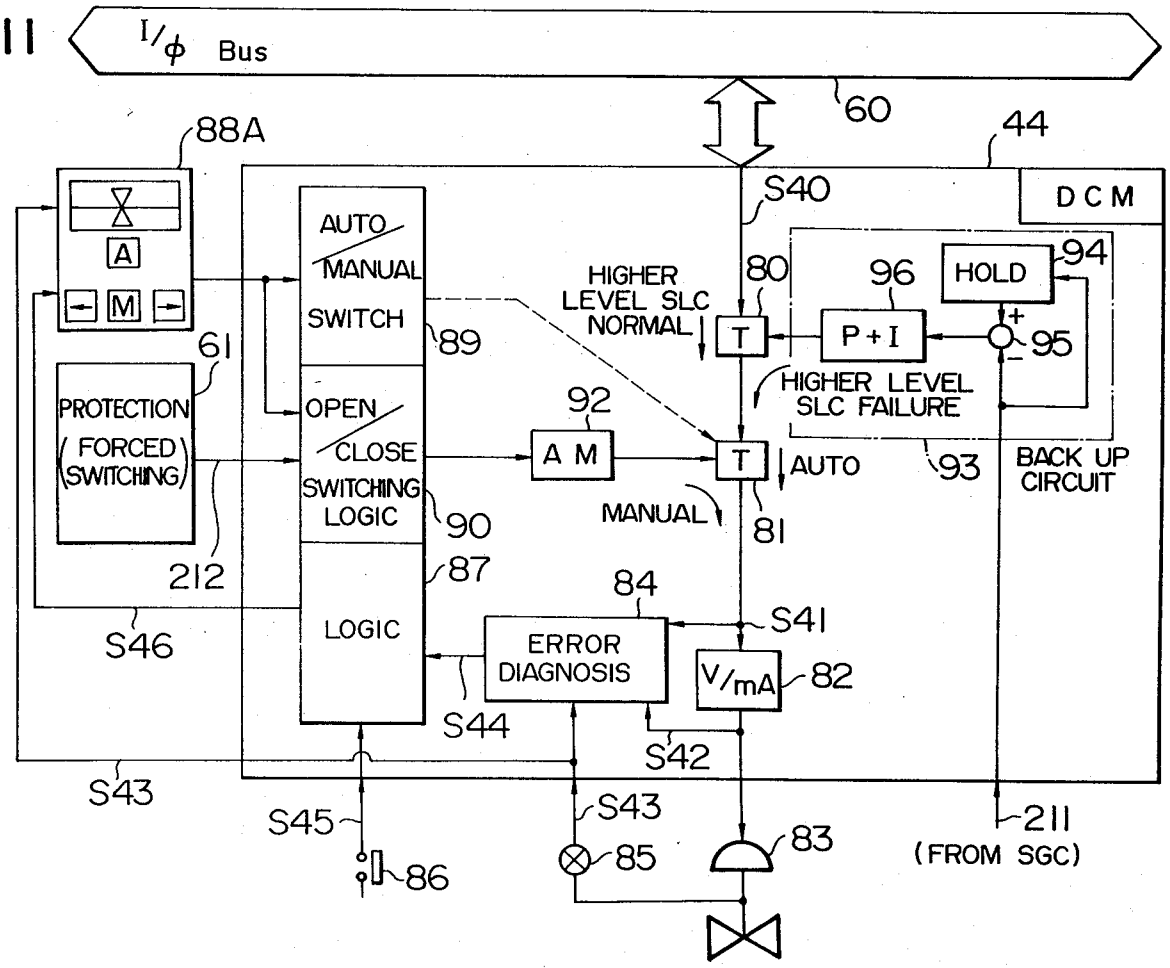
FIG. 11 is a functional diagram of an analog control DCM.

Referring to FIG. 11, the function of the analog controlling DCM is explained. The DCM is basically provided one for each control end. A demand S40 on the opening of the valve 83 supplied from the higher level controller SLC through the I/O bus 60 normally drives the control end 83 through a switch 80, an auto/manual switch 81 and a voltage/current converter 82. A control signal S41 or S42 at the control terminal 83 is compared with a position feedback signal S43 detected by a control end position detector 85, by an error diagnose circuit 84. A comparison output S44 and an input S45 from a control end full open/close limit switch SW 86 are processed by a logic circuit 87 and an output signal S46 therefrom is supplied to a manual operation station 88A which diplays the signal by a lamp. The station 88A also displays the auto/manual operation (A/M) and the opening signal S43 of the valve 83. When an increase or decrease button is depressed in the manual mode (M), the output of the station 88A increases or decreases. As the manual mode (M) is selected, the switch 81 selects the memory 92 through the auto/-manual switching circuit 89. Numeral 90 denotes a switching logic which switches the control end 83 through a memory 92 and the auto/manual switch 81 by a manual switching control signal from the manual operation station 88A and a forced switching signal 212 from a protection circuit 61. Even if the higher level controller fails and the control command from the I/O bus 60 is no longer inputted, the control end can be switched by the manual operation and the function of the protection circuit, as a characteristic of the DCM. Another characteristic of the DCM is a backup circuit 93. In the case of the failure of the higher order controller SLC, a holder 94 holds a process feedback signal 211 supplied through the SGC as a set value, a comparator 95 compares it with the process feedback signal and a proportional integrator 96 and the switch 80 control a process feedback quantity to one immediately before the occurrence of the failure of the higher level controller.

By the functions of the SGC and the DCM, the manual operation is assured, the protection function is assured and the minimum process feedback control function is assured and a simplex configuration of the system is attained even when the higher level controller (sub-loop controller SLC) fails.

Figure 12:
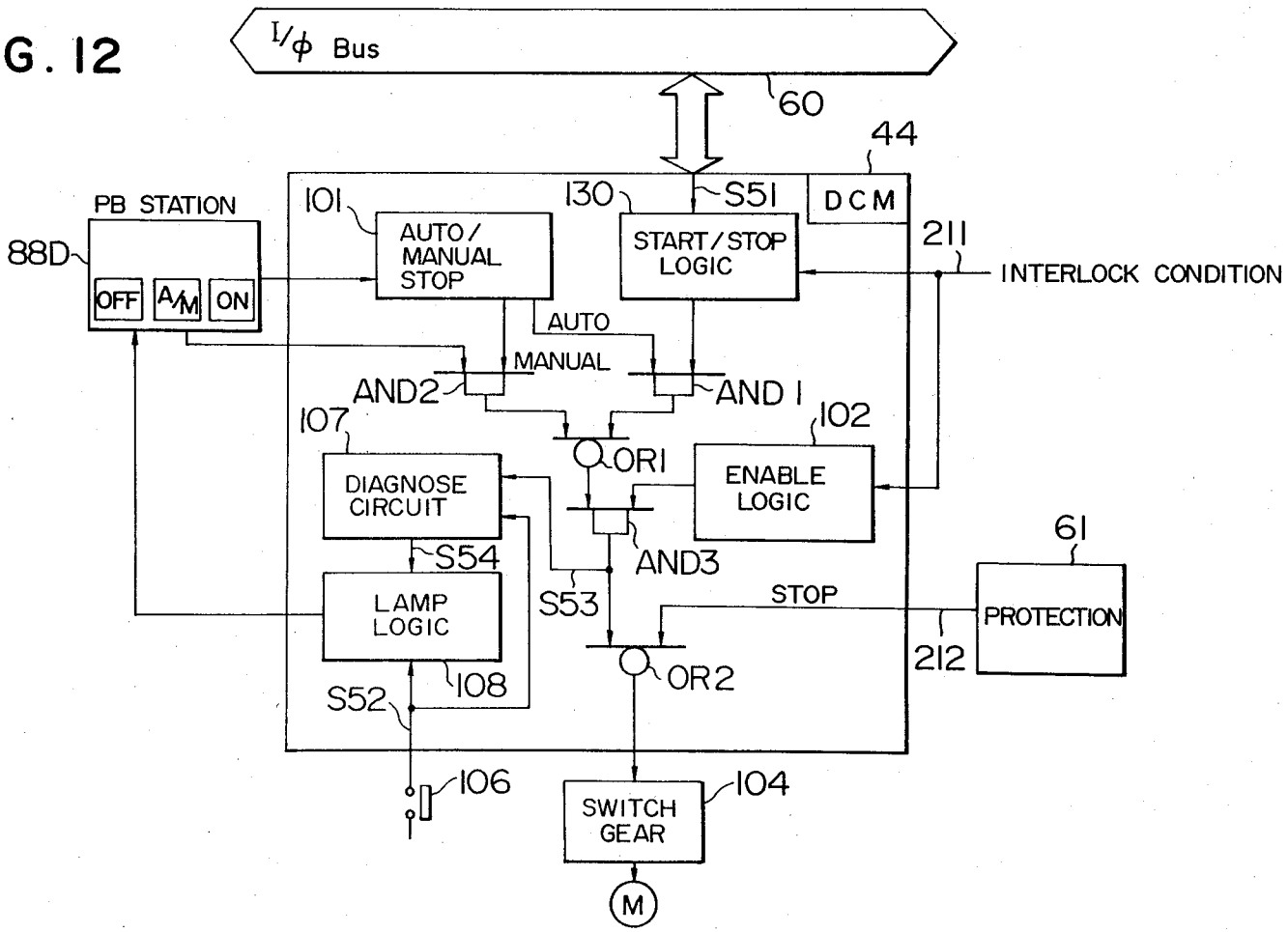
FIG. 12 shows a functional diagram of a digital control DCM.

FIG. 12 shows a detail of the function of the digital controlling DCM. An auto start/stop command SS1 supplied from the higher level controller SLC from the I/O bus 60 is supplied to a start/stop logic 130 which checks if it needs an interlock condition supplied from the SGC through a signal line 211. In the auto-mode, an auto/manual switching circuit 101 activates a switch gear 104 through AND 1, OR 1, AND 3 and OR 2 in accordance with the output of the start/stop logic 130. When the manual mode is selected by the PB station 88D, the circuit 101 turns on or off the switch gear 104 through the AND 2, OR 1, AND 3 and OR 2 in accordance with the manual start/stop command. An enable logic 102 enables the AND 3 only when the interlock condition is met. It is emergency-stopped through the OR 2 by a command 212 from the protection circuit 61. A diagnose circuit 107 diagnoses an error in accordance with anticoincidence of a signal S52 from a contact 106 which is switched by the switch gear 104 and the command signal S53. The diagnose result S54 and the feedback signal S52 are displayed in a PB station 103 through a logic 108. In the digital control, the DCM can also assure the manual start/stop and the forced stop function by the protection logic even if the higher level controller (sub-loop controller) fails.

In the present configuration, when the higher level controller fails, the lower level controller partially backs up the higher level controller so that the reliability of the system is improved. This autonomous control by the present invention is described below.

Figure 13:
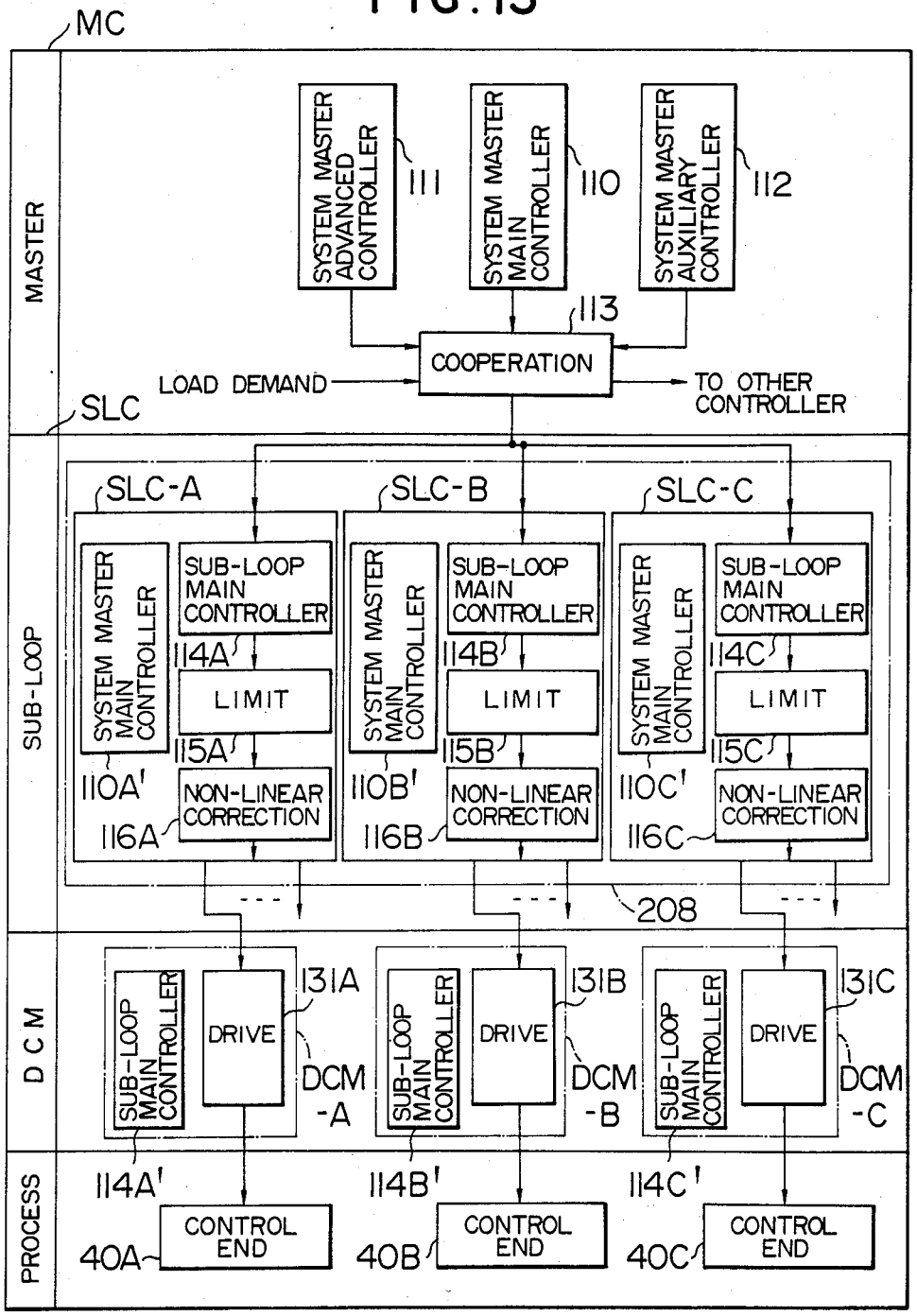
FIGS. 13–15 show a backup method when the controller of the present invention fails.

FIG. 13 shows a control function having the master controller MC, sub-loop controllers SLC's and DCM's. The MC has the following three functions. A system master main controller 110 is essential to cooperative control of the sub-loops. A system master advanced controller 111 improves the controlability of the sub-loops. A system master auxiliary controller 112 includes a limit circuit for the sub-loop control and a start/stop control circuit. The master controller MC prepares a command coodinated among the sub-loop controllers from the load demand and supplies it to the sub-loop controllers SLC-A, SLC-B and SLC-C.

The control function of each sub-loop controller SLC includes a sub-loop main controller 114 essential to the sub-loop controllers, a limit element 115 which is an additional controller, and a non-linear correction element 116.

In the present invention, the system is functionally divided as shown in FIG. 13. Each sub-loop controller SLC has a processor 110' similar to the system master main controller 110 of the higher level master controller MC and each drive control module DCM has a processor 114' similar to the sub-loop main processor 114 of the higher level sub-loop controller SLC. The processors 110' and 114' normally receive the same inputs to those to the controllers 110 and 114 and merely stand by.

Figure 14:
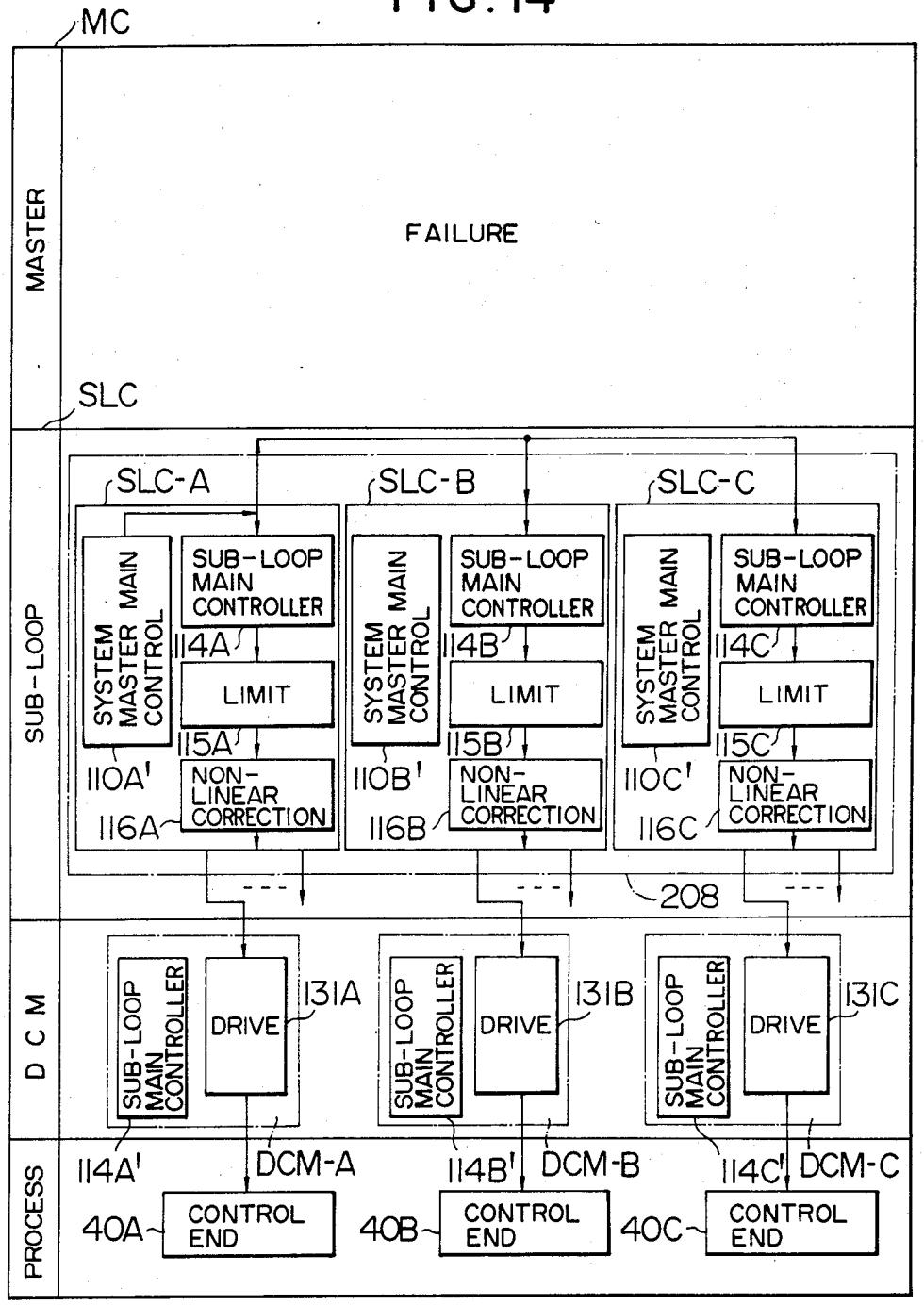

FIG. 14 shows the backup control with a reduced function by the sub-loop controller SLC when the master controller MC fails. Numeral 110'A denotes the same function as that of the system master main controller 110 of FIG. 13, provided in a sub-loop controller SLC-A. When the master controller MC fails, the sub-loop controller SLC-A carries out only the essential portions of the function of the controller 110 of the control function of the master controller MC by the controller 110' to take the place of the master controller MC, and sends commands to the sub-loop controllers SLC-B and SLC-C to keep cooperation among the sub-loop controllers SLC-A to SLC-C. This is the back-up function with the reduced function by the sub-loop controller SLC when the master controller MC fails.

Figure 15:
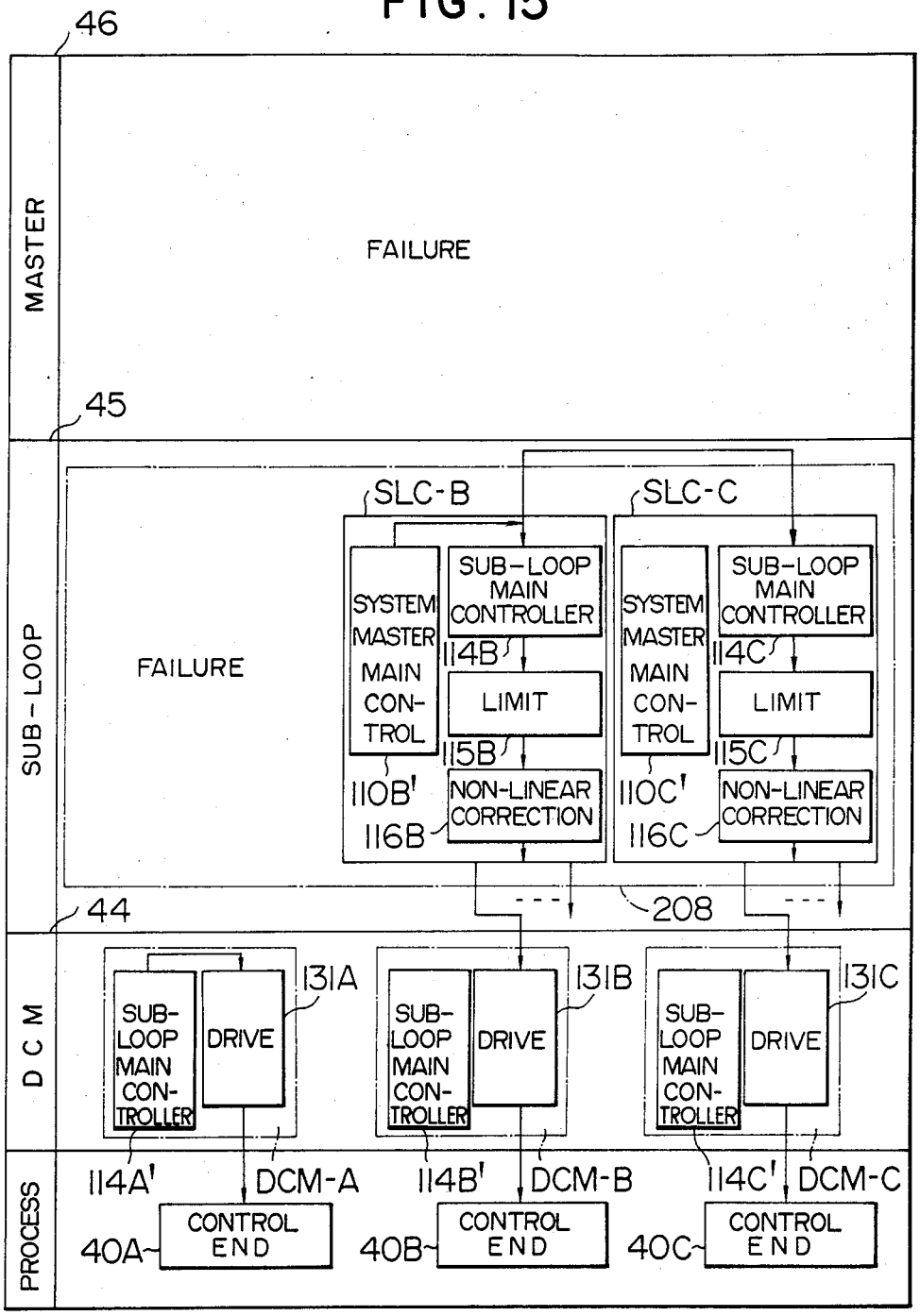

FIG. 15 shows a back-up function with a reduced function by the DCM when the sub-loop controller SLC also fails. Numeral 114' denotes the same function as the sub-loop main control function 114 in the sub-loop controller SLC, provided in the DCM. When the sub-loop controller SLC-A fails, the DCM can execute only the sub-loop main control function. A system master main controller 110B' in the sub-loop controller SLC-B sends commands to the sub-loop controller SLC-C to keep cooperation between the SLC-B and the SLC-C. This is the basic principle of the autonomous control of the high reliability simplex control system by the optimum hierachy distributed arrangement of the controllers in accordance with the plant characteristic and the back-up with the reduced function.

In FIGS. 7A and 7B, the system master main controller and the system master auxiliary controller or the system master advanced controller use the following units.

System master main controller:

B3, B4, B9, B10, B11, AD1, B8, B18, SB5, B19, SET3, SB6, B19, SET1, SB2, B14, B15, B12, SET4, SB7, B20, B13.

System master auxiliary controller:

B5, B6, MP1, B7, AD2, SET2, SB4, B17, AD2.

System master advanced controller:

B2.

Under the above designation, each SLC in the drum type boiler in FIG. 7A uses the following units as the system master main controller 110'.

SLC 1; B3, B4
SLC 2–7; B9, B10, AD1, SB1, B8
SLC 8, 9; B18, B19, SB5, SET3, SB6, B19
SLC 10–12; SET1, SB2, B14, B15
SLC 13, 14; B12
SLC 15; SET4, SB7, B20

In the one-through type boiler of FIG. 7B, each SLC uses the following units.

SLC 1; B3, B4
SLC 10–12; B9, B11, SB3, B16
SLC 13, 14; B12
SLC 2–7; B13, AD1, SB1, B8
SLC 8, 9; B18, SB5, B19, SET3, SB6, B19
SLC 15; SET4, SB7, B20

The function to be equipped in the sub-loop main controller 114' in the DCM may be the same as that of the feedback control or the function generator shown in the SLC of FIGS. 7A and 7B, and the explanation thereof is omitted here.

When the master controller MC of FIG. 14 fails, the fuel flow rate demand 6' is necessary for the operation of the system master main controller 110' in the SLC's 8 and 9 of FIG. 7A. To this end, the signal 6' produced by the system master main controller 110' of the SLC's 2–7 is transferred. Similarly, the electric power demand 2 is required by the SLC's 2–7. To this end, the signal produced by the controller 110' in the SLC is transferred. In FIG. 7B, the necessary signals are also transferred from other SLC's. For example, when the master controller MC of FIG. 14 fails, the fuel flow rate demand 6 is necessary for the operation of the system master main controller 110' in the SLC's 8 and 9 in FIG. 7B. To this end, the signal 6 produced by the system master main controller 110' in the SLC's 2–7 is transferred. The feed water flow rate demand 3 is required by the SLC's 2–7. To this end, the signal 3 produced by the system master controller 110' is transferred. Similarly, the electric power demand 2 required by the SLC's 10–12 is transferred from the SLC 1.

The back-up function with the reduced function in accordance with the present invention is now explained in connection with the feed-water sub-process controller of the drum type boiler shown in FIG. 7A.

Figure 16:
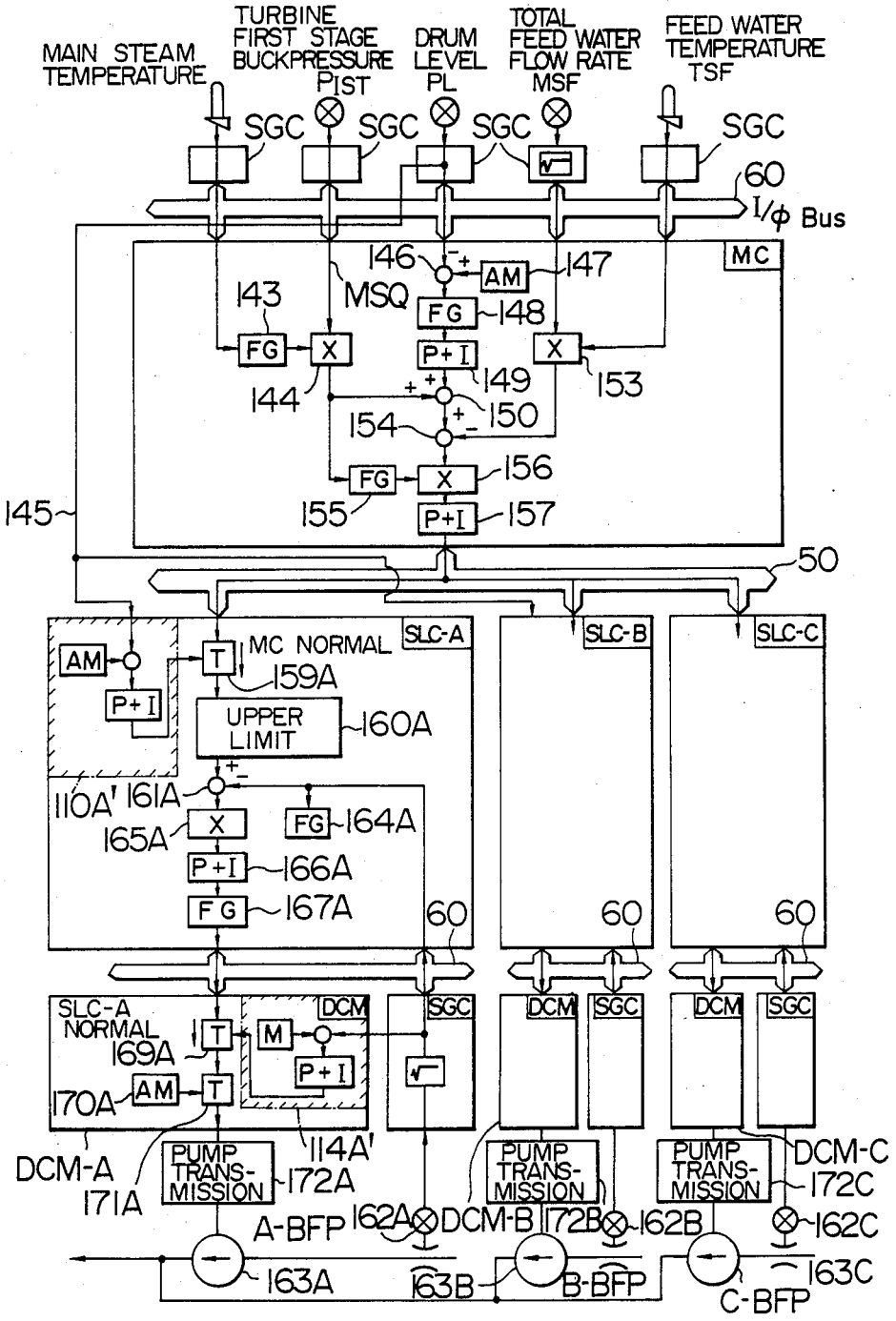
FIGS. 16–18 show embodiments of the present invention applied to a feed water system.

FIG. 16 shows a control in a feed water sub-process II 12 in a normal state. Detection signals relating to the feed water control from the master controller MC are supplied from the SGC's through the I/O bus 60. A turbine first stage back pressure $P_{1ST}$ is converted to a main steam flow rate MSQ by the function generator in the SGC. A main steam temperature MST is applied to a function generator 143 and an output thereof is supplied to a multiplier 144 to correct the main steam flow rate MSQ. A drum level DL is compared with a setting of a setter 147 by a comparator 146 and a difference therebetween is non-linear corrected by a functional generator 148, and an output therefrom is supplied to a proportional integrator 149. An output of the integrator 149 is supplied to an adder 150 which adds thereof to main steam flow rate MSQ to produce a total feed water flow rate demand. A total feed water flow rate MSF is multiplied by a feed water temperature TSF by a multiplier 153, and a product is compared with the demand by a comparator 154. A difference therebetween is corrected by the main steam flow rate MSQ by a function generator 155 and a multiplier 156, and an output of the multiplier 156 is supplied to a proportional integrator 157, and an output therefrom is used as a feed water flow rate demand for each microprocess. This demand is supplied to the feed water sub-loop controllers SLC-A, SLC-B and SLC-C through the serial data transfer loop 50. Numeral 110A' denotes the reduced backup function in the sub-loop controller SLC. The demand from the master controller MC is supplied to a controller 161A through a switch 159A and an upper limit circuit 160A, and compared with a flow rate feedback signal of a feed water pump 163A detected by 162A, and a difference therebetween is multiplied by an output of a function generator 164A by a multiplier 165A, and a product is supplied to a proportional integrator 166A. An output of the integrator 166A is non-linear corrected by a function generator 167A and an output therefrom is supplied to the DCM-A through the I/O bus 60 as a pump rotation speed command. Numeral 114A' denotes a reduced backup function in the DCM-A. The rotation speed command is supplied to a pump transmission 172A through switches 169A and 171A to control a speed.

Figure 17:
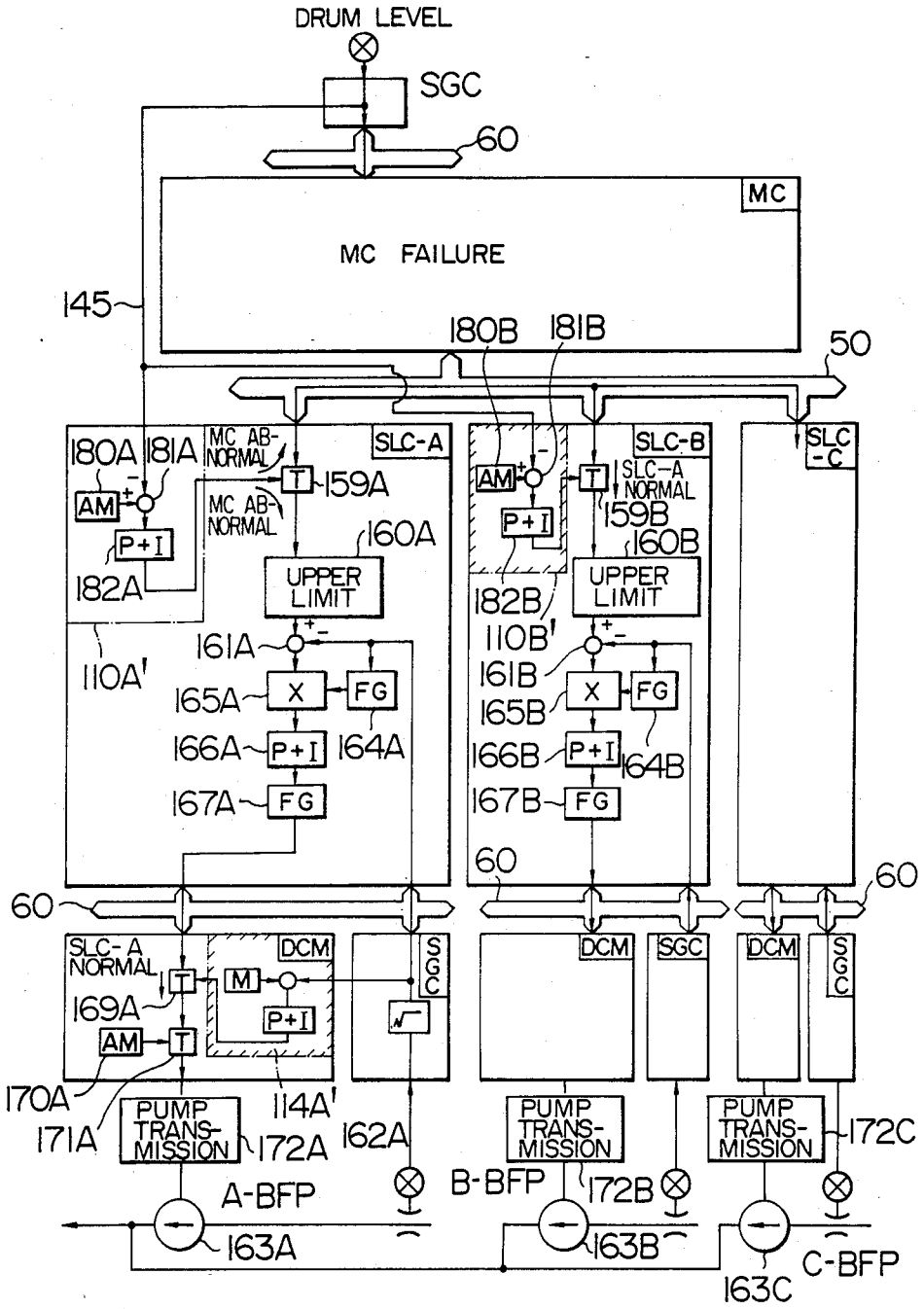

FIG. 17 shows an operation when the master controller MC fails. The reduced backup function 110A' of the feed water sub-loop controller SLC-A operates to supply the feed water demand to the sub-loop controller SLC-B in place of the master controller MC. The SLC-A receives the drum level signal 145 and a comparator 181A compares it with a setting 180A, and a difference therebetween is supplied to a proportional integrator 182A. An output therefrom is used as a feed water demand for the pumps. It is supplied to the SLC-A through the switch 159A as a feed water demand and also supplied to the feed water sub-loops SLC-B and SLC-C through the serial data transmission loop 50 as the feed water demand. In this manner, the feed water sub-loop SLC-A cooperates with the SLC-B and SLC-C to continue the control for the drum level.

The sub-loop controller SLC-A normally monitors the feed water demand from the master controller MC and operates the switch 159A when it detects the absence of the signal.

Figure 18:
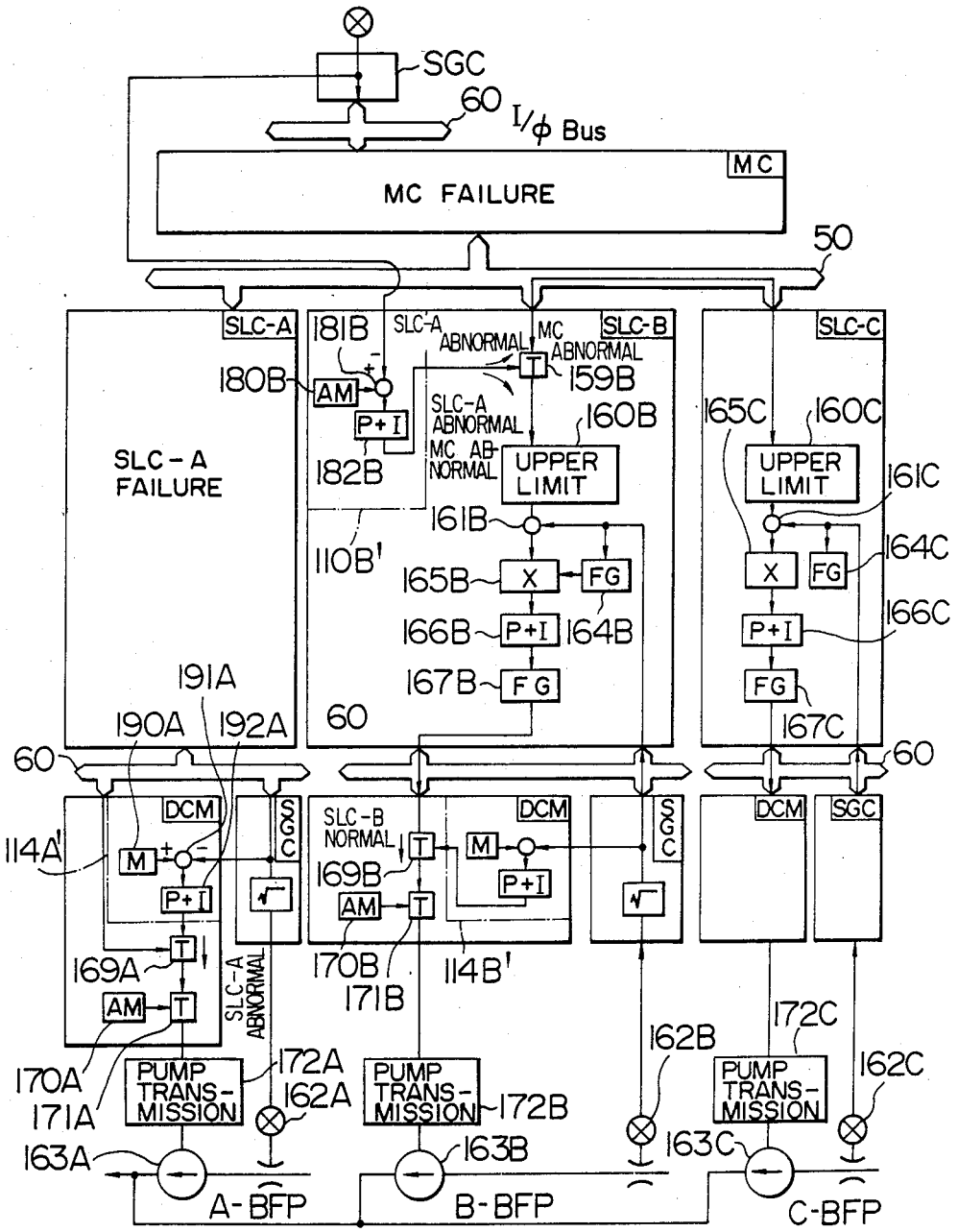

In FIG. 18, the master controller MC as well as the feed water sub-loop controller SLC-A fail. In this case, the control function of the master controller MC is taken over by the reduced backup function 110B' in the feed water sub-loop controller SLC-B, and the demand is supplied to the feed water sub-loop controller SLC-C through the serial data transmission loop 50 so that the drum level control is attained in coordination with the SLC-B and SLC-C.

The DCM-A in the feed water sub-loop controller SLC-A can achieve the feedback control of the pump flow rate by the reduced backup function 114A' in the PCM-A. The pump flow rate signal from the detector 162A, supplied from the SGC to the DCM-A is compared with a setting 190A by a comparator 191A, and a difference therebetween is supplied to a proportional integrator 192A, which produces a pump speed command, which in turn is supplied to a pump transmission 172A through a switch 169A to control the speed.

The DCM normally monitors the feed water flow rate signal to the feed water microprocess supplied from the sub-loop controller SLC and operates the switch 169A when it detects the absence of the signal, as the sub-controller does.

FIG. 19 shows process input signals required for the sub-loop controllers SLC of the respective systems to partially back up the control function of the higher level master controller MC when the MC fails. Those process signals are used as control signals to construct the system master main control circuit in the sub-loop controller SLC. As a result, the SLC can follow a slow load change of 3%/min although it cannot follow a fast load change which can be followed by the master controller MC when it is normal. For example, in the drum type boiler, the drum level in the feed water system, the main steam pressure in the fuel system, the gas $O_2$ in the air system, the furnace draft in the gas system and the reheat steam pressure in the recirculation system are the process signals.

When the sub-loop controller SLC fails, the cascade control by the demand by the sub-loop controller is not attained but the DCM reads in the process signals at the control ends controlled by the DCM and uses those process signals as the control signal to construct the sub-loop main control circuit in the DCM to allow the fixed value feedback control by the setting in the DCM in order to absorb minor process disturbance at each control end. FIG. 20 shows an example of process signals read into the DCM when the SLC fails.

The feed water pump flow rate in the feed water sub-loop, the coal flow rate and the primary air flow rate for each mill in the fuel sub-loop and fan discharge pressures in the air, gas and recirculation sub-loop are the process signals to achieve the above object.

The sub-loop controller SLC is assigned one for each group of the same type of control ends for each system. (For example, 3 groups in the feed water system, 6 groups in the fuel system and 2 groups in the air system.) Accordingly, if one SLC fails and the control ends controlled by the associated lower level DCM are controlled by the fixed value feedback control by the setting in the DCM, the control ends controlled by the remaining normal SLC's can be cascadecontrolled and the SLC's can follow certain load change.

As described hereinabove, according to the present invention, the hierachy distributed simplex system power plant can continue the operation even if the controller fails, and an economical and reliable control system is provided.

We claim:

1. A controller for a heat power plant comprising:

a master controller for receiving a load demand and a plurality of plant data from the heat power plant and producing command signals on at least two of electric power, feed water flow rate, fuel flow rate, air flow rate and recirculation gas flow rate of the plant required to achieve the load demand;

a plurality of sub-loop controllers independently provided for respectively receiving said command signals for producing control quantities for controlling control ends in accordance with the command signals;

a plurality of drive means provided one for each of the control quantities supplied by the sub-loop controllers; and a plurality of plant data detection means for detecting the plant data and delivering the plant data to said master controller or said sub-loop controllers, said sub-loop controllers including processor means respectively for determining a substitute command signal on the basis of the plant data and issuing the substitute command signal to the sub-loop controllers for producing control quantities when the master controller fails.

2. A controller for a heat power plant according to claim 1 wherein said processor means issues a substitute electric power command signal for achieving a frequency control of electricity.

3. A controller for a heat power plant according to claim 1 wherein said processor means issues a substitute feed water feed rate command signal for achieving a boiler drum level control of a drum type boiler.

4. A controller for a heat power plant according to claim 1 wherein said processor means issues a substitute feed water feed rate command signal for achieving a main steam pressure control of a one-through type boiler.

5. A controller for a heat power plant according to claim 1, wherein said processor means issues a substitute fuel flow rate command signal for achieving a main steam pressure control of a drum type boiler.

6. A controller for a heat power plant according to claim 1, wherein said processor means issues a substitute fuel flow rate command signal for achieving a main steam temperature control of a one-through type boiler.

7. A controller for a heat power plant according to claim 1, wherein said processor means issues a substitute air flow rate command signal for achieving a boiler gas oxygen concentration control.

8. A controller per a heat power plant according to claim 1, wherein said processor means issues a substitute recirculation gas flow rate command signal for achieving a boiler reheat steam temperature control.

9. A controller for a heat power plant according to claim 4, wherein said processor means issues a signal corresponding to the deviation between the plant data and a predetermined set value as the substitute command signal.

10. A controller for a heat power plant comprising:

a master controller for receiving a load demand and a plurality of plant data from the heat power plant and producing command signals on at least two of electric power, feed water flow rate, fuel flow rate, air flow rate and recirculation gas flow rate of the plant required to achieve the load demand;

a plurality of sub-loop controllers independently provided for said command signals respectively for producing control quantity signals for controlling control ends in accordance with the command signals;

a plurality of drive means provided for receiving the control quantity signals supplied by the sub-loop controllers respectively; and a plurality of plant data detection means for detecting the plant data and delivering the plant data to said master controller, said drive means including back-up means respectively for determining a substitute control quantity signal and issuing the substitute control quantity signal main control function of its one when the sub-loop controller to the drive means in order to control the control ends when a sub-loop controller fails.

* * * * *